United States Patent [19]

Levy et al.

[11] Patent Number: 4,540,139

[45] Date of Patent: Sep. 10, 1985

[54] PASSIVE MISSILE HOMING SYSTEM

[75] Inventors: Pierre Levy, Boulogne-Billancourt; André Robert, Eaubonne, both of France

[73] Assignee: Societe Anonyme de Telecommunications, France

[21] Appl. No.: 516,118

[22] Filed: Jul. 20, 1983

[30] Foreign Application Priority Data

Jul. 27, 1982 [FR] France ..... 82 13108

[51] Int. Cl.[3] ..... F41G 7/22

[52] U.S. Cl. ..... 244/3.19; 343/424

[58] Field of Search ..... 244/3.15, 3.16, 3.19; 343/424, 445, 357

[56] References Cited

U.S. PATENT DOCUMENTS

| | | | |
|---|---|---|---|
| 3,181,813 | 5/1965 | Gulick, Jr. et al. | 244/3.19 |
| 3,740,002 | 6/1973 | Schaefer | 244/3.19 |
| 4,108,400 | 8/1978 | Groutage et al. | 244/3.15 |
| 4,204,655 | 5/1980 | Gulick et al. | 244/3.19 |
| 4,264,907 | 4/1981 | Durand, Jr. et al. | 244/3.19 |

*Primary Examiner*—Charles T. Jordan

*Attorney, Agent, or Firm*—Jacobs & Jacobs

[57] ABSTRACT

A passive homing system for missiles is provided having at least three interferometric bases each comprising two electromagnetic antennae disposed on the missile. Said three interferometric bases have respective mid-perpendicular planes which are inclined two by two at 120° with respect to each other.

4 Claims, 4 Drawing Figures

PASSIVE MISSILE HOMING SYSTEM

BACKGROUND OF THE INVENTION

The present invention relates to a passive missile homing system, called "self-director", comprising at least three interferometric bases, each having two electromagnetic antennae disposed on the missile.

Infrared self-directors are already known. Their accuracy is very high and they may then advantageously guide a missile at the end of its flight path, close to the target. However, their range is relatively limited.

Electromagnetic self-directors of the above-mentioned type are also known. Their accuracy is not as good but their range is wide and they may advantageously take charge of the missile at a great distance from the target and guide it within the vicinity thereof.

However, in these known electromagnetic self-directors, the elaboration of the guidance orders is effected in two perpendicular planes. When the missile, to which they are fixed, rotates laterally, which is generally the case, there are losses of information when the polarizations of the bases are perpendicular to the polarization of the radiation to be received. Furthermore, there may also be a loss of the range of use, even in stabilized flight, in the case of reception interference, at one antenna or more, between the direct signal and the signal reflected from the ground or from the sea. This phenomenon may moreover also occur with circular polarization antennae which, all the same, risk being blind for receiving signals polarized in a reverse circular direction.

The present invention aims at palliating these disadvantages.

SUMMARY OF THE INVENTION

To this end, the present invention provides a passive missile homing system called "self-director" comprising at least three interferometric bases each having two electromagnetic antennae disposed on the missile, wherein the three interferometric bases have respective mid-perpendicular planes which are inclined two by two at 120° with respect to each other.

With the invention, whatever the polarization of the radiation received and whatever the rolling position of the missile and the target, guidance orders may be elaborated over a wide field of use.

In a preferred embodiment of the system of the invention, the two antennae of each interferometric base are small and disposed at a small distance from each other, and a conventional infrared homing device is provided forming, in combination with the interferometric bases, a sequential operation bimode self-director.

In this case, and preferably on a small-size missile, since the electromagnetic self-director is compact and is thus combined with an infrared self-director, the first self-director may take over at a great distance until in the vicinity of the target, to be then relayed by the second self-director as far as the target.

BRIEF DESCRIPTION OF THE DRAWINGS

The present invention will be better understood from the following description of a preferred embodiment of the system of the invention, with reference to the accompanying drawings in which.

DETAILED DESCRIPTION OF THE PREFERRED EMBODIMENT

Figure 1:
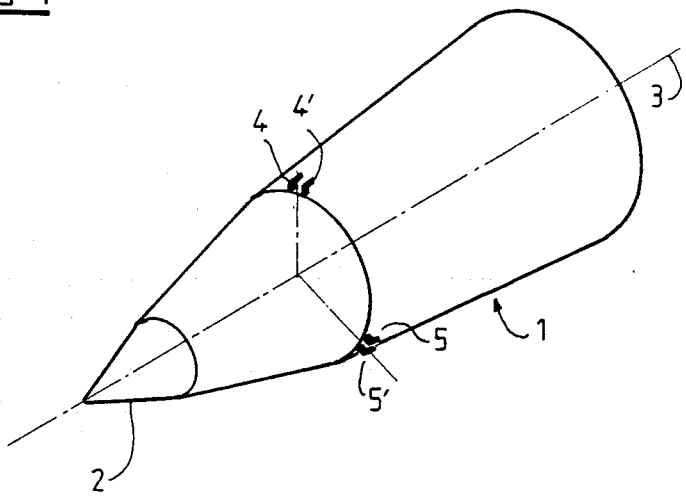
FIG. 1 is a profile view of the head of the missile on which the system of the invention is mounted.
Figure 2:
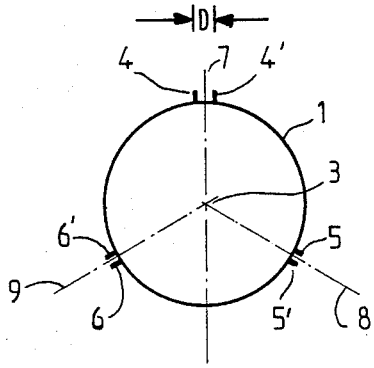
FIG. 2 shows schematically antennae of the system of FIG. 1.

In FIG. 1 is shown the head 1 of a missile with axis 3, whose travel path is to be made dependent on a target to be reached which emits more particularly electromagnetic radiation, for example by its radar, as well naturally as infrared radiation.

The electromagnetic self-director which will be described is combined with an infrared self-director, known moreover, disposed in the front tip 2 of the missile.

The two electromagnetic infrared self-directors form a passive bimode self-director, operating sequentially, the first one first of all from the moment when the missile is taken in charge to the vicinity of the target, then the second as far as the target.

On the outer wall of head 1, very slightly behind tip 2, are fixed substantially in the same plane perpendicular to the axis of the missile, three pairs of small closely spaced receiving antennae 4,4'; 5,5'; 6,6', of which one is not visible in FIG. 1, forming the three antennae of three interferometric bases, identical in the example considered, of the electromagnetic self-director of the invention.

The mid-perpendicular planes 7, 8, 9 of these three bases are inclined two by two at 120° with respect to each other.

Figure 3:
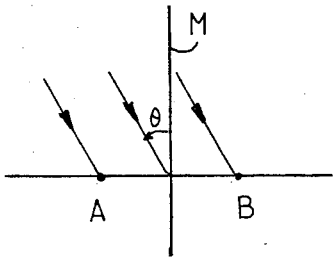
FIG. 3 shows schematically one illustration of an interferometric base.

Referring to FIG. 3, we will recall the principle of an interferometric base.

Let A and B be the points where two antennae of the base are set up, M the mid-perpendicular plane of the base, D the distance between the two antennae, $\theta$ the angle of incidence of the electromagnetic radiation from the target received by the antennae, with respect to its mid-perpendicular plane M and $\lambda$ the wavelength of the radiation.

The two signals delivered by the two antennae of the base are shifted in phase by an angle $\Delta\psi$ given by the relationship:

$$\Delta\psi = 2\frac{D}{\lambda}\sin\theta$$

Knowing this phase-shift, the angle of incidence $\theta$ of the radiation from the target may then be deduced therefrom by the relationship:

$$\theta = \arcsin\frac{\Delta\psi}{2\pi}\ \frac{\lambda}{D}$$

The knowledge of two angles of incidence $\theta_1$ and $\theta_2$ of the same radiation, with two interferometric bases, would allow the bearing and the elevation of the missile to be calculated by changing coordinates. If the mid-perpendicular planes of these two bases were already perpendicular to each other, the coordinate change would be avoided. However, a self-director with two bases would leave a shadow zone or a mask. In the case of orthogonal bases, four bases orthogonal two by two would be required to eliminate this shadow zone. However, with three bases spaced apart angularly by 120°, this mask problem is overcome. Furthermore, with a self-director having four bases orthogonal two by two, no information would be collected on one of the two pairs of bases, should a signal with crossed polarization be received. This is finally why a self-director is used having three bases spaced apart angularly two by two by 120°. Whatever the polarization of the incident radiation, and whether the missile rotates on itself or not, the system supplies the desired information.

It wil be noted here that, with the two antennae of the same base being close to one another, i.e. their distance D is small, the indetermination of the phase-shift $\Delta\psi$ is also small.

Having thus three phase-shift informations $\Delta\psi_1$, $\Delta\psi_2$, and $\Delta\psi_3$, delivered by the three bases disposed at 120° with respect to each other, computing and processing means, known per se, disposed in the missile determine the desired elevation and bearing in two perpendicular planes, i.e. the guidance orders, which are then applied, also in a manner known per se, to the circuit controlling the control surfaces of the missile, so as to make the travel path dependent on the target.

For whatever purpose it may serve, we will again recall the method for transforming the three angular informations obtained $\theta_1$, $\theta_2$, $\theta_3$ into elevation and bearing guidance orders, $\theta_1$ and $\theta_4$: from $\theta_1$ and $\theta_2$ by the relationship $$\sin\theta_4 = \frac{\sin\theta_2 + \frac{\sin\theta_1}{2}}{\sin\frac{\pi}{3}}$$

from $\theta_1$ and $\theta_3$, by the relationship $$\sin\theta_4 = \frac{\sin\theta_3 + \frac{\sin\theta_1}{2}}{\sin\frac{\pi}{3}}$$

from $\theta_2$ and $\theta_3$ by the relationships $$\sin\theta_1 = -(\sin\theta_2 + \sin\theta_3)$$

$$\sin\theta_4 = \frac{1}{\sqrt{3}}(\sin\theta_2 - \sin\theta_3).$$

Figure 4:
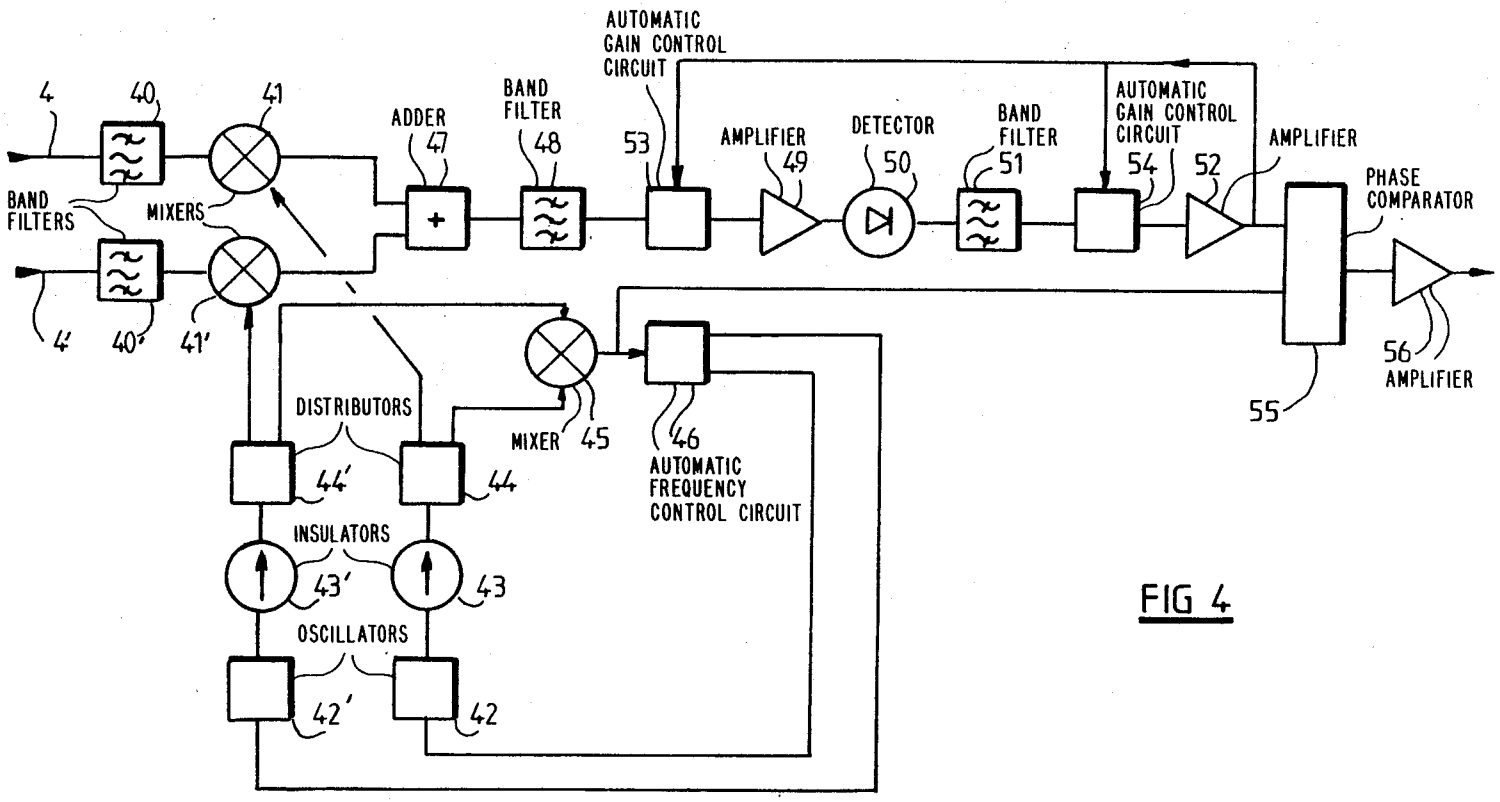
FIG. 4 is the block diagram of one of the receivers of the system of the invention.

The circuits of the magnetic self-director will now be described, with reference to FIG. 4 which concerns one of the three channels associated respectively with the three interferometric bases, the other two being identical.

Each channel comprises in fact a superheterodyne receiver receiving the signals from the two antennae of the associated base, for example 4, 4'.

These signals are first received in band filters 40,40', before being subjected respectively to different frequency changes in mixers 41,41', connected respectively by their first inputs to the outputs of filters 40,40'.

Two local oscillators 42,42' are connected for this purpose to the second inputs of mixers 41,41' through insulators 43,43' and dispatchers 44,44'. The two dispatchers 44,44' are further connected to a mixer 45, itself connected to an automatic frequency control circuit 46 which is looped across the two oscillators 42,42' so as to maintain the difference between their frequencies constant, equal in the example considered to 70 MHz.

The two separate frequency signals from mixers 41, 41' are added in an adder 47, followed by a band filter 48.

Thus, the two signals from the two reception antennae of the base, of a frequency between 5 and 15 GHz, arrive, added, at the input of the receiver properly speaking, at a frequency of the order of 1.5 GHz.

At the output of filter 48 are connected a first amplifier 49, followed by a detector 50, a band filter 51 at the tuning frequency and a second amplifer 52.

The output of the second amplifier 52 is re-inserted into two automatic gain control circuits 53,54 connected respectively between the filter 48 and the amplifier 49, on the one hand and filter 51 and amplifier 52 on the other.

At the output of amplifier 52, a signal is obtained at the tuning frequency equal to the difference between those of the two oscillators 42,42' and phase-shifted with respect to the signal from mixer 45 by the angular deviation desired $\Delta\psi_1$.

The output signal of amplifier 52 and the output signal of mixer 45 are fed into a phase comparator 55, which supplies then an error signal representative of the angular deviation information $\Delta\psi_1$. This signal is then amplified in an amplifier 56 before being fed, with the other two signals representative of the deviations $\Delta\psi_2$, $\Delta\psi_3$ into the computer of the above-mentioned computing and processing means, which work out the angles $\theta_1$, $\theta_2$, $\theta_3$ then $\theta_4$ and delivers to the circuit controlling the control surfaces of the missile the elevation and bearing guidance orders for making the travel path of the missile dependent on the target.

The above-described receiver is a wide-band receiver which may receive and process any signal whatever its modulation.

In accordance with the invention, a sequential bimode self-director may be set up in a small-size missile, having a magnetic self-director for taking the missile in charge as far as about one or two kilometers from the target and a more accurate infrared self-director then taking over, still in a conventional way, from the magnetic self-director as far as the target, the antennae of the magnetic self-director being preferably, as in the example shown and illustrated, disposed just behind the infrared tip.

We claim:

1. A passive homing system for missiles, comprising at least three interferometric bases each having two electromagnetic antennae disposed on the missile, characterized in that said three interferometric bases have respective mid-perpendicular planes which are inclined two by two at 120° with respect to each other.

2. The system as claimed in claim 1, wherein the two antennae of each interferometric base are small and disposed at a small distance from each other, and a conventional infrared homing device is provided forming, in combination with the interferometric bases, a sequential operation bimode self-director.

3. The system as claimed in claim 2, wherein said infrared device is disposed in the front tip of the missile and the electromagnetic antennae of the interferometric bases are disposed on the head of the missile, very slightly behind the tip.

4. The system as claimed in claim 1, wherein the signals delivered by said interferometric bases are received in wide-band receivers.

* * * * *